US007331375B2

(12) United States Patent
Suzuki et al.

(10) Patent No.: US 7,331,375 B2
(45) Date of Patent: Feb. 19, 2008

(54) METAL MOLDING METHOD AND APPARATUS

(75) Inventors: Hideyuki Suzuki, Kariya (JP); Koichiro Sato, Kariya (JP); Ryuichi Onoda, Kariya (JP)

(73) Assignee: Denso Corporation, Kariya (JP)

( * ) Notice: Subject to any disclaimer, the term of this patent is extended or adjusted under 35 U.S.C. 154(b) by 85 days.

(21) Appl. No.: 11/181,490

(22) Filed: Jul. 14, 2005

(65) Prior Publication Data

US 2005/0247427 A1 Nov. 10, 2005

Related U.S. Application Data

(62) Division of application No. 10/229,871, filed on Aug. 28, 2002, now Pat. No. 6,938,669.

(30) Foreign Application Priority Data

Aug. 30, 2001 (JP) ..... 2001-262007

(51) Int. Cl.
*B22D 17/00* (2006.01)

(52) U.S. Cl. ..... 164/312; 164/72

(58) Field of Classification Search ..... 164/72, 164/113, 312

See application file for complete search history.

(56) References Cited

U.S. PATENT DOCUMENTS 5,819,839 A * 10/1998 Mihelich et al. ..... 164/312
6,460,596 B1 * 10/2002 Yamaguchi et al. ..... 164/72
6,938,669 B2 * 9/2005 Suzuki et al. ..... 164/72

FOREIGN PATENT DOCUMENTS

| | | |
|---|---|---|
| JP | 05-285622 | 11/1993 |
| JP | 6-39258 | 5/1994 |
| JP | 06-285777 | 10/1994 |
| JP | 10-166140 | 6/1998 |
| JP | 11-254120 | 9/1999 |
| JP | 11-300462 | 11/1999 |
| JP | 2000-079459 | 3/2000 |
| JP | 2001-25852 | 1/2001 |
| JP | 2001-025852 | 1/2001 |
| JP | 2001-138025 | 5/2001 |
| JP | 2001-170748 | 6/2001 |
| JP | 2001-321913 | 11/2001 |

* cited by examiner

*Primary Examiner*—Kevin P. Kerns
(74) *Attorney, Agent, or Firm*—Harness, Dickey & Pierce, PLC

(57) ABSTRACT

According to the present invention, between the mold-clamping process S1 in which the mold 1 is closed and the injection-pressure increase (solidifying) process S3, the gate-melting process for heating the hot runner 21 to melt the plug (metallic material) of the gate 27, the mold-lubricant coating process for spraying the lubricant onto the wall surface of the cavity 10, and the material-metering process are simultaneously carried out in parallel to each other. Thus, the molding cycle time can be reduced to a great extent.

9 Claims, 3 Drawing Sheets

INVENTIVE MOLDING CYCLE

PRIOR ART MOLDING CYCLE

METAL MOLDING METHOD AND APPARATUS

CROSS-REFERENCE TO RELATED APPLICATIONS

This application is a divisional of U.S. patent application Ser. No. 10/229,871 filed on Aug. 28, 2002 now U.S. Pat No. 6,938,669. This application claims the benefit of JP 2001-262007, filed Aug. 30, 2001. The disclosure(s) of the above application(s) is (are) incorporated herein by reference.

BACKGROUND OF THE INVENTION

1. Field of the Invention

The present invention relates to a method and apparatus for molding a metal, and particularly magnesium alloy or the like, using an injection-molding machine and a hot runner.

2. Description of the Related Art

In general, a thixo-molding apparatus has an injection mechanism and a clamping mechanism. Mold material, which is metallic chips of magnesium alloy or the like supplied from a hopper, is transferred by a screw into a cylinder heated to a predetermined temperature to be put into a liquidized or a semi-melted state, which develops thixotropy (the property exhibited by certain gels of becoming fluid when stirred or shaken and returning to the semi-solid state upon standing, while not varying the temperature), in a co-existing state of a solid and a liquid, by applying a shearing force through the rotating screw. After this metallic material has been charged to a tip end of the cylinder, it is injected into a mold, held at a predetermined pressure and cooled to be a metallic molded product.

In this regard, a prior art system for molding magnesium alloy in this thixo-molding apparatus employs a molding cycle, shown in FIG. 3, comprising a mold-clamping process T1, a gate melting process T2, an injection-pressure increase (solidifying) process T3, a material-metering process T4, a mold-opening process T5, a product withdrawal process T6, a mold-lubricant coating process T7 and an air-blow process T8, while the solidifying process and the material-metering process are carried out in parallel to each other.

That is, first, the mold-clamping process for closing the mold is carried out. Then, the gate-melting process T2 for heating a hot runner is carried out to melt a plug (metallic material) at a tip end of a plug of the hot runner. When the injection becomes possible through the gate-melting process T2, the injection-pressure increase (solidifying) process T3 is carried out, wherein the melted or semi-melted metallic material is injected while increasing the pressure for preventing a sink mark from occurring due to the solidification shrinkage. Thereafter, the material-metering process T4 for preparing material for the next injection is carried out. During the metering of material, the metallic material filled in the mold is quenched by the heat-conduction to the mold and solidified. If the metallic material has been completely solidified and the mold product is in a state capable of being withdrawn from the mold, the mold-opening process T5 for opening the mold is carried out. Thereafter, the product withdrawal process T6, the mold-lubricant coating process T7 and the air-blow process T8 are conducted to complete one cycle of the molding processes. In the above cycle, as the material-metering process needs a relatively long time, it starts at an instant corresponding to the initiation of the solidifying process so that it is in time for the completion of the mold-clamping process.

However, when the material-metering process starts parallel to the solidifying process, the other processes must proceed after the material-metering process has completed, whereby a waiting time is necessary until the mold-clamping process has completed. In the thixo-molding method, it is an optimum condition, for obtaining a high-quality metallic mold product, that the metallic material is injected into the mold while exhibiting the thixotropy so that an apparent viscosity is lowered. However, as described before, if there is a waiting time after the completion of the material-metering process prior to the injection, the thixotropy of the metallic material in the co-existing state of solid and liquid charged in the cylinder is lost, and there may be a problem in that the metallic material is injected while maintaining a high viscosity to deteriorate the quality of the metallic mold product.

To solve this problem, Japanese Unexamined Patent Publication No. 2001-25852 proposes a method for molding a metallic product using a thixo-molding apparatus. In this method, a time at which the material-metering process starts is determined to make the completion of the mold-clamping process coincide with the finishing of the material-metering process, so that the metallic material as metered is immediately injectabled into the mold just clamped, whereby the above-mentioned waiting time is eliminated. However, this method is problematic in that the mold-lubricant coating process is carried out after a mold-opening process and prior to the mold-clamping process so that the metallic material-metering process and the mold-lubricant coating process are simultaneously carried out while the mold is in a open state. Thus, there is a risk in that molten metal drops down from the tip end of the injection nozzle to adhere to a touch surface of a nozzle or a metallic mold face to result in lack of touching of the nozzle or clamping of the mold, which may cause a risk of flash during the injection. Also, the mold-lubricant itself may splash out of the mold to worsen the working environment.

According to the metal molding method disclosed in the above publication, although the molding-lubricant coating process requiring a relatively large working time is carried out simultaneously with the material-metering process, the former is independent from processes other than the material-metering process, whereby it does not provide a solution for saving time necessary for the molding cycle. Thus, a saving of the cycle time cannot be expected because the effect of saving the solidification time by the use of a hot runner is reduced by the process requiring the relatively large working time.

SUMMARY OF THE INVENTION

The present invention is intended to solve the above problems in the prior art in which the mold-lubricant coating process, the material-metering process and the gate-melting process are carried out parallel to each other, and an object of the present invention is to provide a method and apparatus for producing a metallic mold product, capable of reducing a cycle time to a great extent, preventing the lubricant from being splashed outward and avoiding pollution of the working environment.

According to one aspect of the present invention, a method for molding metal by using the thixo-molding method is provided, wherein a gate-melting process for heating the metallic material solidified in a tip end portion of a nozzle of the hot runner, a mold-lubricant coating process for spraying a mold-lubricant onto a wall surface of the mold, and a material-metering process for metering the metallic material are carried out simultaneously in parallel to each other between a mold-clamping process for closing the mold and an injection-pressure increase process for injecting the metallic material into the mold. Thereby, the cycle time of the molding cycle can be reduced. Also, as the mold-lubricant can be coated while closing the mold, it is possible to prevent the lubricant from splashing outside the mold, whereby the working environment is improved.

In the method for molding metal according to the present invention, after a mold-opening process for opening the mold, a metallic mold product-withdrawal process and an air-blow process may be simultaneously carried out in parallel to each other, whereby the cycle time of the molding cycle can be further reduced.

An apparatus for molding metal according to one aspect of the present invention comprises mold-clamping and opening means for closing the mold and opening the mold; injection-pressure increase means for injecting the metallic material into the clamped mold; gate-melting means for heating the hot runner to melt metallic material solidified at a tip end of a nozzle of the hot runner; mold-lubricant coating means for spraying the lubricant onto a wall surface of a cavity within the clamped mold; material-metering means for metering the metallic material by the displacement of the screw; and control means for controlling the operations of the above-mentioned means; and wherein the gate-melting means, the mold-lubricant coating means and the material metering means are simultaneously operated in parallel to each other under the control of the control means, after the mold has been clamped by the mold-clamping and opening means and prior to injecting the metallic material into the mold and increasing the pressure by the injection-pressure increase means.

An apparatus for molding metal according to another aspect of the present invention further comprises product-withdrawal means for withdrawing the metallic mold product from the mold by the action of an ejector pin and an air-blow means for applying an air blow onto the mold to clean a wall surface of the cavity and the material supply path wherein, after the mold has opened by the mold-clamping and opening means, the product-withdrawal means and the air-blow means are simultaneously operated in parallel to each other under the control of the control means.

The present invention may be more fully understood from the description of the preferred embodiments of the invention, as set forth below, together with the accompanying drawings.

DESCRIPTION OF THE PREFERRED EMBODIMENTS

Figure 1:
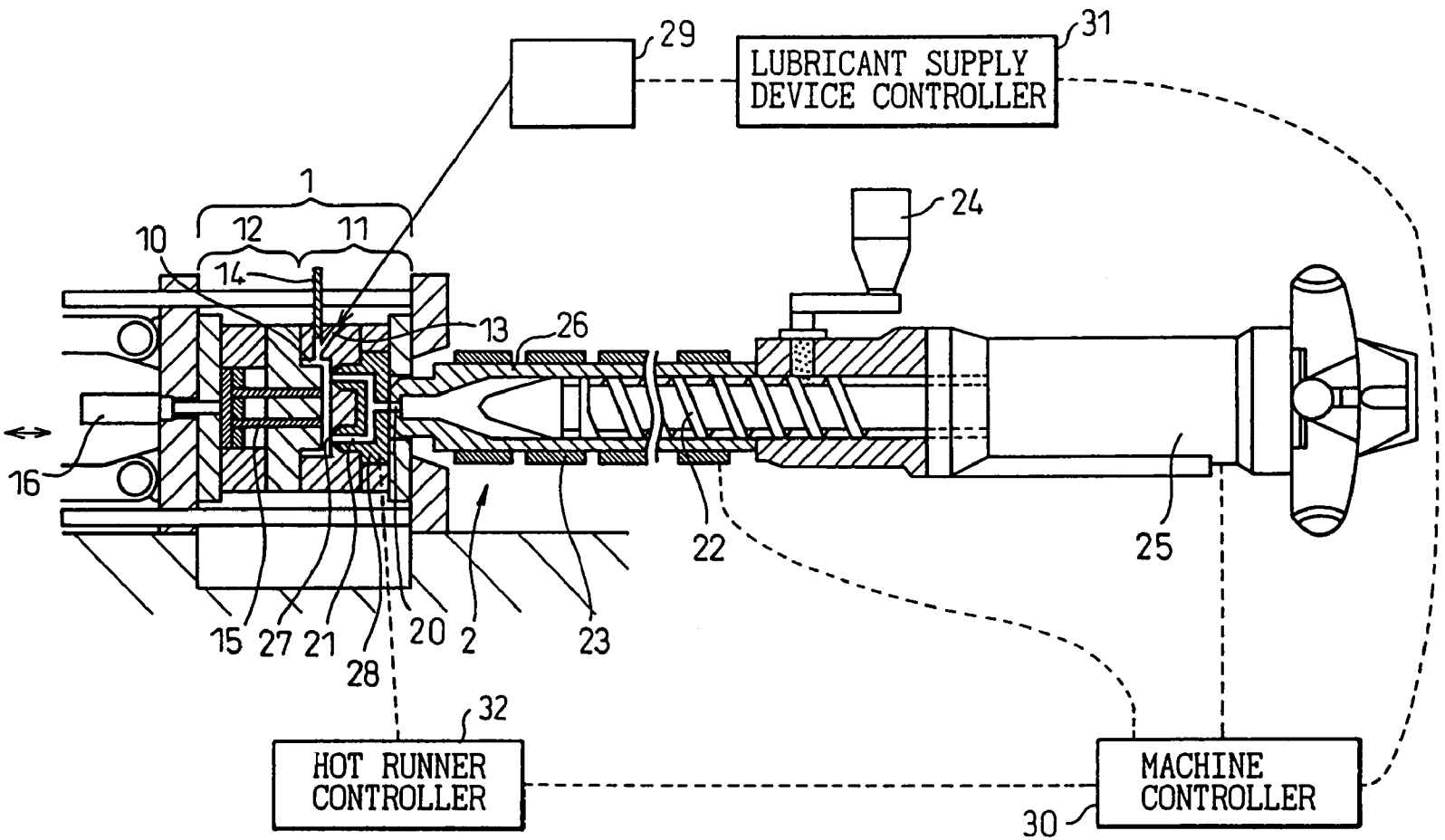
FIG. 1 illustrates an over all structure of a thixo-molding apparatus (an apparatus for producing a metallic mold product) used for carrying out a method for molding a metallic mold product according to one embodiment of the present invention.

A method and apparatus for producing a metallic mold product according to one embodiment of the present invention will be described with reference to the attached drawings. FIG. 1 illustrates an over all structure of a thixo-molding apparatus (an apparatus for producing a metallic mold product) used for carrying out a method for molding a metallic mold product according to one embodiment of the present invention. The thixo-molding apparatus (the apparatus for producing a metallic mold product) has a mold 1 including a stationary mold 11 and a movable mold 12. The mold 1 defines a cavity 10 by clamping the stationary mold 11 and the movable mold 12, for molding a metallic material such as a magnesium alloy or others.

To actuate the movable mold 12, a motorized mold driving mechanism, not shown, is provided so that the movable mold 12 is movable forward and backward relative to the stationary mold 11. Also, the movable mold 12 is provided with an ejector pin 15 and a driving mechanism 16 thereof.

The stationary mold 11 has a hot runner 21 communicated with the cavity 10. The hot runner 21 has a gate 27 in a portion communicated with the cavity 10 and is encompassed with a heat source 28 as a whole. The hot runner 21 is connected via an injection nozzle 20 to an injection cylinder 26 of an injection mechanism 2 provided outside the stationary mold 11. A screw 22 is disposed within the injection cylinder 26 and a heater mechanism 23 is provided on the outer circumference of the injection cylinder 26. A hopper 24 for supplying a metallic material is provided in communication with the interior of the injection cylinder 26. A screw driving mechanism 25 for driving the screw 22 is provided adjacent to the injection cylinder 26. Thus, the metallic material supplied from the hopper 24 is conveyed through the interior of the injection cylinder 26 by the rotation of the screw 22, during which the material is melted and the melted metal is supplied into the cavity 10 from the injection nozzle 20 via the hot runner 21.

According to the thixo-molding apparatus of the present invention, to spray the mold-lubricant when the mold 1 is clamped, a lubricant supply path 13 is communicated with the exterior of the stationary mold 11. The lubricant supply path 13 is connected to a lubricant supply device 29 and supplied with the lubricant in, for example, a piston system or the like. An interruption pin 14 for opening and closing the lubricant supply path 13 is disposed within the stationary mold 11 to be movable forward and backward.

The operation control of the thixo-molding apparatus according to the present invention is basically carried out by a machine controller 30. That is, the lubricant supply device 29 is operated by a lubricant supply device controller 31 connected to the machine controller 30 so that the supply of the lubricant is controlled. Similarly, the heat source 28 of the hot runner 21 is controlled by a hot runner controller 32 connected to the machine controller 30 so that the temperature thereof is managed. Further, the machine controller 30 also controls the operations of the screw driving mechanism 25, the heater mechanism 23 on the outer circumference of the injection cylinder 26, a mold driving mechanism (not shown), the driving mechanism 16 for the ejector pin 15, the interruption pin 14 of the lubricant supply path 13 or others.

Figure 2:
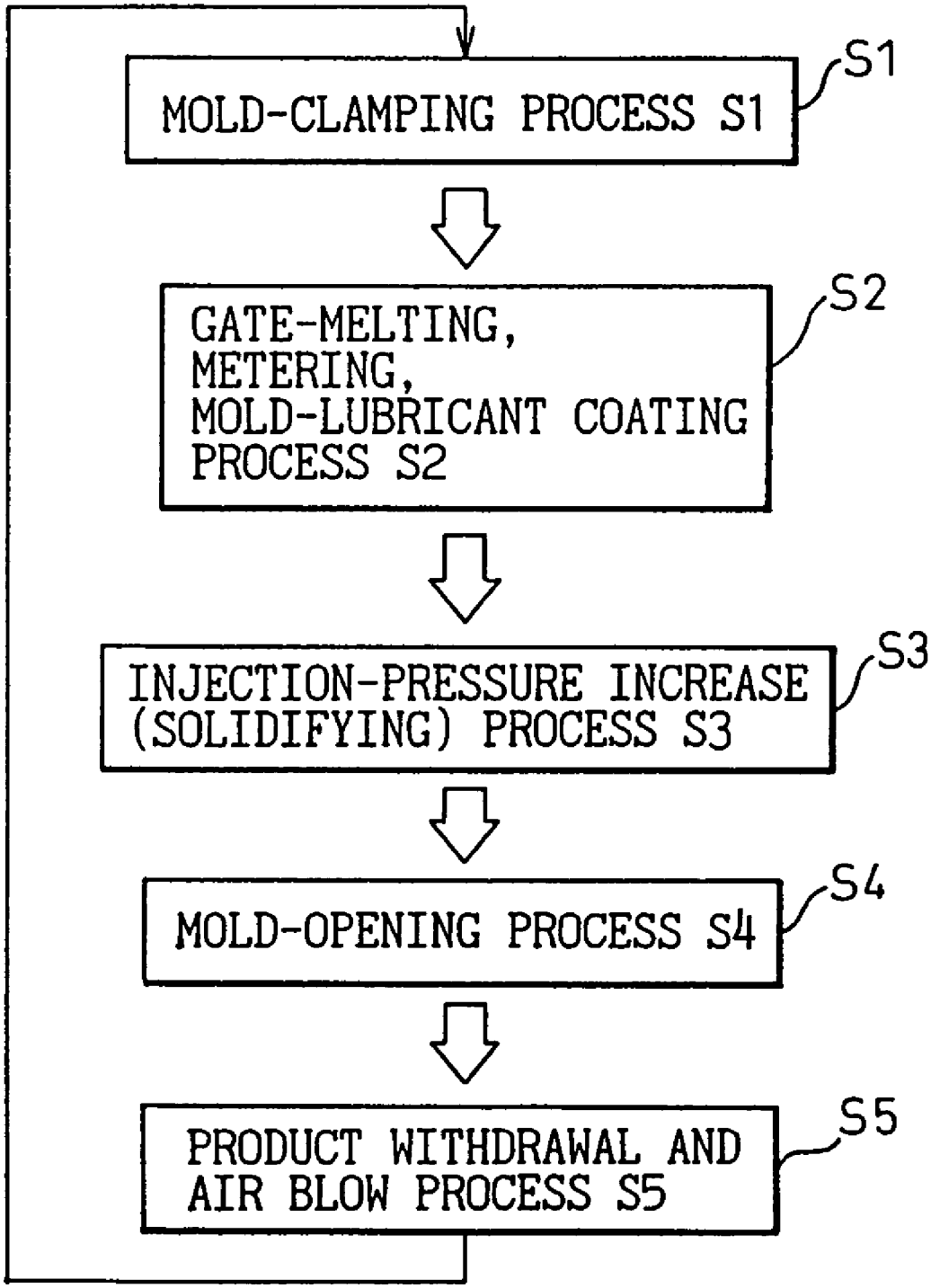
FIG. 2 is a flow chart illustrating a molding cycle of a method for producing a metallic mold product according to the embodiment of the present invention.

The operation of the method for producing a metallic mold product according to the present invention using the thixo-molding apparatus will be described based on a flow chart shown in FIG. 2.

At step S1, the mold driving mechanism is driven to bring the movable mold 12 in contact with the stationary mold 11 and the mold 1 is firmly clamped (the mold-clamping process).

Then, at step S2, the injection nozzle (not shown) of the lubricant is introduced into the lubricant supply path 13, and the lubricant is ejected to wall surfaces including a wall surface of the cavity 10 to be in contact with the supplied metallic material, by the lubricant supply device 29 through the ejection nozzle and the lubricant supply path 13 so that a lubricant film is formed on the wall surface (the mold-lubricant coating process).

Simultaneously therewith, at step S2, to melt the solidified plug (metallic material) at a tip end of the gate 27 of the hot runner 21, the hot runner 21 is heated by the heat source 28 controlled by the hot runner controller 32, whereby the gate is melted (the gate melting process).

Further, at step S2, an injection mechanism 2 is used to meter the metallic material (the material-metering process). The metering of the metallic material is carried out so that a displacement (a backward displacement) of the screw 22 from a predetermined position is controlled by means of the screw driving mechanism 25. This displacement may vary in accordance with various conditions such as a weight of the resultant metallic mold product.

That is, at step S2, the mold-lubricant coating process, the gate melting process and the material-metering process are simultaneously carried out.

Subsequently, at step S3, the screw 22 is advanced by the screw driving mechanism 25, and melted metallic material is injected from the gate 27 of the hot runner 21 to fill the cavity 10 with a necessary amount of the melted metal. In this case, to prevent a sink mark being generated, the pressure is increased (the injection-pressure increase (solidifying) process). After being filled with metallic material, the mold 1 is cooled to solidify the melted metallic material. In this case, the lubricant supply path 13 is of course closed by the forward motion of the interruption pin 14.

After the melted metallic material has completely solidified, the movable mold 12 is detached from the stationary 11 by driving the mold driving mechanism to open the mold at step S4 (the mold-opening process).

Then, at steps 5, the driving mechanism 16 disposed in the thixo-molding apparatus is operated to extend the ejector pin 15 to withdraw the mold product from the mold (the product withdrawal process).

Simultaneously, at step S5, an air stream may be applied to wall surfaces of the cavity 10 from an air-blow nozzle (not shown) connected to a pneumatic pressure source to remove burrs adhered to the wall surfaces (the air blow process).

Thereafter, the mold is clamped again and the above molding cycle is repeated.

A series of the molding cycle are controlled by the machine controller 30.

Figure 3:
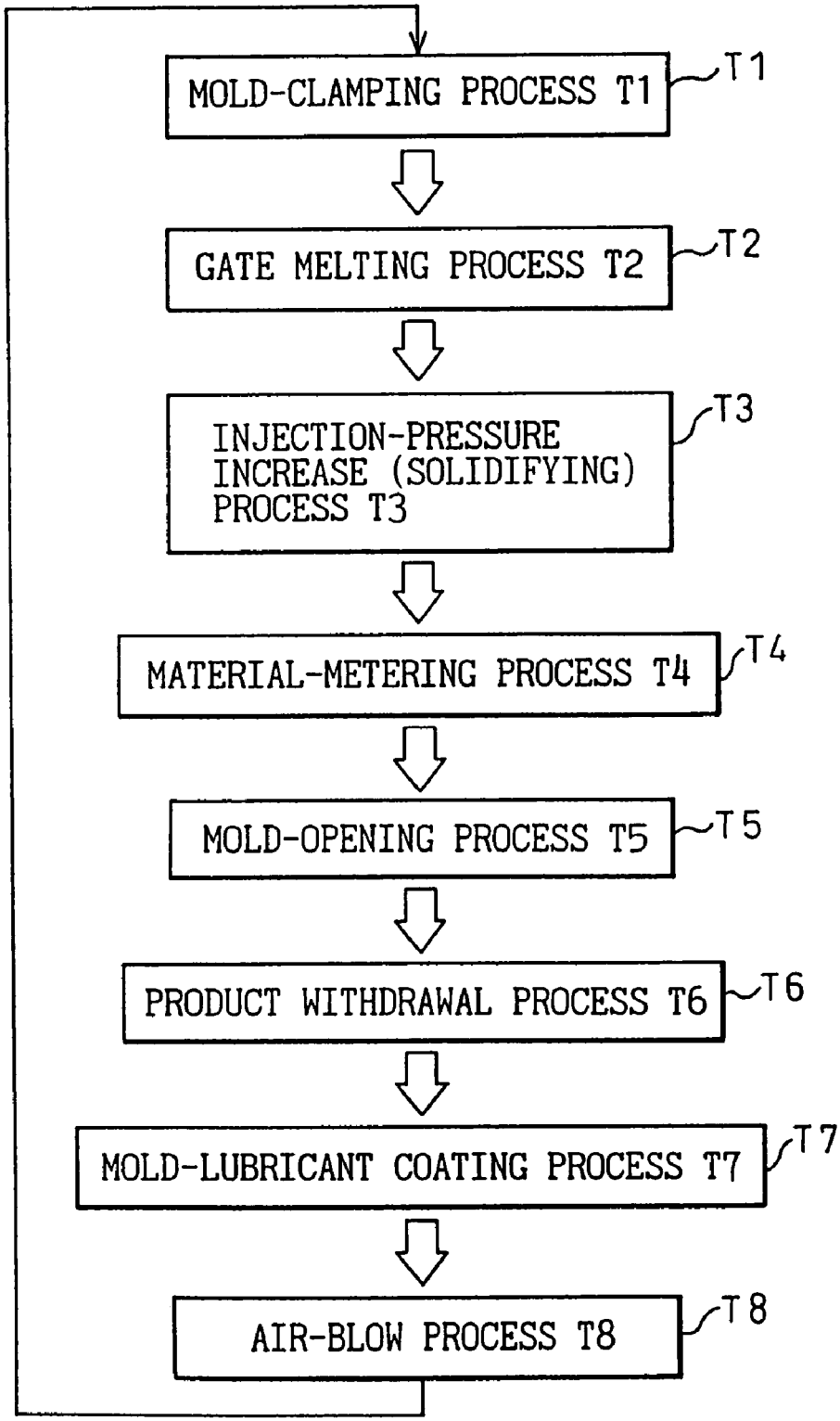
FIG. 3 is a flow chart of the prior art molding cycle.

The inventive molding cycle shown in FIG. 2 with the prior art molding cycle shown in FIG. 3 will be explained below based on experiments while comparing the cycle times between the both.

According to the prior art molding cycle, the mold-clamping process T1—3 seconds the gate-melting process T2—3 seconds the injection-pressure increase (solidifying) process T3—3 seconds the material-metering process T4—11 seconds the mold-opening process T5—4 seconds the product withdrawal process T6—4 seconds the mold-lubricant coating process T7—10 seconds the air-blow process T8—6 seconds, and the cycle time is 44 seconds.

Contrarily to this, according to the inventive molding cycle, the mold-clamping process S1—3 seconds the gate-melting, metering, mold-lubricant coating processes S2—11 seconds the injection-pressure increase (solidifying) process S3—3 seconds the mold-opening process S4—4 seconds the product withdrawal, the air-blow processes S5—4 seconds, and the cycle time is 25 seconds, which is approximately a half of the prior art cycle time.

Next, the operation and the effect of the present invention will be described.

Generally speaking, the gate melting cannot be conducted until the mold is closed for the sake of safety. Accordingly, the gate melting process can be solely conducted after the mold-clamping process and prior to the injection-pressure increase (solidifying) process. In general, it is solely the material-metering process which can be incorporated as a composite operation. However, if the lubricant coating can be carried out while the mold is closed, the lubricant-coating process is also incorporated as a composite operation. Furthermore, as the material-metering process and the mold-lubricant coating process have a much longer cycle time than the other processes, it is possible to shorten the molding cycle time to a great extent by incorporating these processes into a composite operation (parallel operation).

As the lubricant is sprayed after the mold has been clamped, split surfaces of the stationary and movable molds have already been brought into contact with each other, whereby the lubricant never adheres to these split surfaces. Also, as the mold has been clamped to isolate the cavity and the material-supply path from outside, it is possible to prevent the lubricant from adhering to an unnecessary portion or splashing to outside.

This prevents the deterioration of the working environment as well as suppresses useless consumption of the lubricant. This enables undiluted lubricant to be used without water for diluting the lubricant, whereby it is possible to prevent the mold temperature from lowering due to the adhesion of the lubricant to the mold and to ensure the favorable distribution of, for example, molten magnesium alloy having a small heat capacity.

As described above, the method and apparatus for molding metal according to the present invention is particularly suitable for magnesium alloy, but is not limited thereto. While the description has been made in the above arrangement on a case wherein the lubricant-supply path is provided in the stationary mold, the lubricant-supply path may be provided in the movable mold, provided the supply of the lubricant is possible even if the mold is closed.

Any kind of lubricant may be used, including an oil type or one diluted with a solvent other than water. Also, the lubricant may be applied not only by spraying but also by any other methods including suction or the like.

While the invention has been described by reference to specific embodiments chosen for purposes of illustration, it should be apparent that numerous modifications could be made thereto by those skilled in the art without departing from the basic concept and scope of the invention.

What is claimed is:

1. An apparatus for molding metal by conveying a chipped metallic material with a screw into a closed mold cavity defined by a mold through a hot runner located in the mold heated to a predetermined temperature, charging the heated metallic material in a semi-melted or liquidized state at a tip end of the hot runner, injecting such metallic material into the closed mold cavity, and cooling the material to mold a metallic mold product, wherein the apparatus comprises;

mold-clamping and opening means for closing the mold to form the closed mold cavity and opening the mold;

injection-pressure increasing means for injecting the metallic material into the closed mold cavity;

gate-melting means located in the mold for directly heating the hot runner located in the mold to melt metallic material solidified at a tip end of a nozzle of the hot runner;

mold-lubricating means for spraying lubricant onto a wall surface of the closed mold cavity;

material-metering means for metering the metallic material by the displacement of the screw; and control means for controlling the operations of the above-mentioned means; and means for simultaneously activating the gate-melting means for heating the hot runner, the mold-lubricating means for spraying the lubricant and the material-metering means for metering the metallic material.

2. An apparatus for molding metal as defined by claim 1, further comprising product-withdrawal means for withdrawing the metallic mold product from the mold by the action of an ejector pin and an air-blow means for applying an air blow onto the mold to clean a wall surface of the cavity and the material supply path, wherein after the mold has opened by the mold-clamping and opening means, the product-withdrawal means and the air-blow means are simultaneously operated in parallel to each other under the control of the control means.

3. The apparatus for molding metal as defined by claim 1, wherein the gate-melting means, the mold-lubricant coating means and the material metering means are simultaneously activated after the mold has been closed and prior to the injecting of the metallic material into the closed mold cavity.

4. The apparatus for molding metal as defined by claim 1, wherein the lubricant is an undiluted solution or a diluted solution in a liquid state.

5. An apparatus for molding metal by conveying a chipped metallic material with a screw into a closed mold cavity defined by a mold through a hot runner heated to a predetermined temperature, charging the heated metallic material in a semi-melted or liquidized state at a tip end of the hot runner, injecting such metallic material into the closed mold cavity, and cooling the material to mold a metallic mold product, wherein the apparatus comprises;

mold-clamping and opening means for closing the mold to form the closed mold cavity and opening the mold;

injection-pressure increasing means for injecting the metallic material into the closed mold cavity;

metallic material melting means for melting the metallic material located in the injection-pressure increasing means;

gate-melting means for heating the hot runner to melt metallic material solidified at a tip end of a nozzle of the hot runner, the gate-melting means being separate from the metallic material melting means;

mold-lubricating means for spraying the lubricant onto a wall surface of the closed mold cavity;

material-metering means for metering the metallic material by the displacement of the screw; and control means for controlling the operations of the above-mentioned means; and means for simultaneously activating the gate-melting means for heating the hot runner, the mold-lubricating means for spraying the lubricant and the material-metering means for metering the metallic material.

6. An apparatus for molding metal as defined by claim 5, further comprising product-withdrawal means for withdrawing the metallic mold product from the mold by the action of an ejector pin and an air-blow means for applying an air blow onto the mold to clean a wall surface of the cavity and the material supply path, wherein after the mold has opened by the mold-clamping and opening means, the product-withdrawal means and the air-blow means are simultaneously operated in parallel to each other under the control of the control means.

7. The apparatus for molding metal as defined by claim 5, wherein the gate-melting means, the mold-lubricant coating means and the material metering means are simultaneously activated after the mold has been closed and prior to the injecting of the metallic material into the closed mold cavity.

8. The apparatus for molding metal as defined by claim 5, wherein the lubricant is an undiluted solution or a diluted solution in a liquid state.

9. The apparatus for molding metal as defined by claim 1, wherein the gate-melting means is located in the mold.

* * * * *